US005794686A

United States Patent [19]

Baumann et al.

[11] Patent Number: 5,794,686

[45] Date of Patent: Aug. 18, 1998

[54] STEAM CONDENSER

[75] Inventors: Peter Baumann, Sulz; Christian Stucki, Zürich, both of Switzerland

[73] Assignee: Asea Brown Boveri AG, Baden, Switzerland

[21] Appl. No.: 814,320

[22] Filed: Mar. 11, 1997

[30] Foreign Application Priority Data

Mar. 15, 1996 [DE] Germany ..... 196 10 237.5

[51] Int. Cl.[6] ..... F28B 1/00

[52] U.S. Cl. ..... 165/114; 165/112

[58] Field of Search ..... 165/111–114

[56] References Cited

U.S. PATENT DOCUMENTS

| | | | |
|---|---|---|---|
| 3,363,678 | 1/1968 | Forster et al. | 165/114 X |
| 5,465,784 | 11/1995 | Blangetti et al. | 165/114 |

FOREIGN PATENT DOCUMENTS

| | | |
|---|---|---|
| 423819 | 5/1967 | Germany . |
| 1948073 | 3/1971 | Germany . |
| 29 35 106 | 3/1981 | Germany . |
| 3732633 | 4/1989 | Germany . |
| 44 22 344 | 1/1996 | Germany . |

*Primary Examiner*—Leonard R. Leo
*Attorney, Agent, or Firm*—Oblon, Spivak, McClelland, Maier & Neustadt, P.C.

[57] ABSTRACT

In a steam condenser in which the steam is condensed on tubes (13) through which cooling water flows and which are combined in separate banks (20), each bank (20) being subdivided into compartments (10) by supporting plates (5) arranged perpendicularly to the tubes (13), a residual-steam/inert-gas mixture is drawn out of a precooler (2) via orifices (9) into an air cooler (3). The residual steam is condensed in the air cooler (3) and the collecting condensate (23) flows off on account of a slope of the air-cooler bottom (21) through a recess (18) to an adjacent compartment (10) having an air-cooler bottom (21) situated at a lower level. In this case, the condensate (23) flowing off from a compartment (10) situated at a higher level is retained at a retaining wall (22) on the air-cooler bottom (21) of the compartment (10) having the air-cooler bottom situated at the lowest level, this retaining wall (22) being arranged parallel to a supporting plate (5). Due to the retained condensate (23), the recesses (18) in the supporting plates for the condensate flow from a compartment (10) situated at a higher level can be closed hydraulically in both a gas-tight and a steam-tight manner.

2 Claims, 2 Drawing Sheets

STEAM CONDENSER

BACKGROUND OF THE INVENTION

1. Field of the Invention

The invention relates to a steam condenser as described in the preamble of claim 1.

2. Discussion of Background

Such a steam condenser is disclosed by CH-C 423 819 and DE-A 1 948 073. There, the condenser tubes are arranged in a plurality of so-called sectional banks in a condenser casing. The steam flows is through an exhaust-steam connection into the condenser casing and is distributed in the space by steam entry lanes. The free inflow of the steam to the outer tubes of the sectional banks is ensured. The steam then flows through the banks with a small resistance due to the small depth of the tube rows. In order to be able to fulfill the condition of the steam velocity to be kept sufficiently high in the inflow passages, the sectional banks in the condenser are arranged next to one another in such a way that flow passages are obtained between them, which in sectional view appear of the same order of magnitude as the sectional banks themselves. Furthermore, the tubes in the rows following one after the other form a permeable enclosure which preferably constitutes an identical hydraulic resistance throughout.

This known condenser has the advantage that, due to the more open arrangement of the sectional banks, all peripheral tubes of a sectional bank are readily fed with steam without a noticeable pressure loss.

The condensers working under vacuum require a suction system which functions effectively so that incoming, non-condensable gases are always removed from the condensation region. Cooling tubes which are surrounded by these gases mixed with steam or around which these gases flow are almost completely lost as condensation area, a factor which reduces the performance.

This means that the vacuum cannot be kept to the lowest possible value due to the incoming, non-condensable gases. As is known, non-condensable gases—usually air—even in concentrations of 1% mole fraction at temperature differences between wall and steam core of 4 to 5 K, bring about a reduction in the steam-side heat transfer—with virtually static steam—to 30–40% of that value which can be achieved with pure steam. The vacuum loss is thus revealed in a lower efficiency of the cycle system.

An inflow arrangement of the tubes is put into practice in the abovementioned solution according to DE-A 1 948 073. The sectional banks are subdivided into compartments by supporting plates arranged perpendicularly to the tubes. As is known, the condensation performance along the cooling tubes mainly depends on the local temperature difference between steam and cooling water. Accordingly, the condensation performance of the first compartments at the cooling-water inlet side will condense more than that of the compartments at the cooling-water outlet side. Non-condensable gases will accordingly collect to an increasing degree in the "cooler" compartments—in proportion to the condensation performance. In order to take this into account the inert-gas enrichment zone is of two-part design in the condenser according to DE-A 1 948 073, which will be described in detail later in connection with FIG. 1. It consists of a funnel-shaped "precooler", called "secondary condensation part" there, and an air cooler which communicates with the precooler and a downstream header via a double row of uniformly distributed cooler inlet orifices and cooler outlet, orifices respectively. This air cooler is geometrically configured in such a way that the impairment of the steam-side heat transfer is partly compensated for by an increase in the velocity of the gas phase.

In the air cooler, each supporting plate has a recess toward the bottom of the air cooler, which recess serves as a drain opening for condensate collecting in the air cooler. For the draining of the air cooler, its bottom is provided over the entire longitudinal orientation with a slope, according to which collecting condensate from the compartments having an air-cooler bottom situated at a higher level flows off toward the air-cooler bottom situated at the lowest level. The compartment having the air-cooler bottom situated at the lowest level is drained by means of a line leading into the condensate receiver of the condenser.

Since the condensation performance of the air cooler is adapted to the approximate temperature profile of the cooling water in the adjacent tubes, the air cooler therefore provides for suitable venting of the precooler approximately in proportion to the non-condensable gases collecting.

However, such an air-cooler construction does not represent an ideal solution for the different venting to be dealt with in various compartments during varying operating conditions. Here, undesirable equalization flows of residual-steam/inert-gas mixture may occur, which could entail an impairment of the condenser efficiency.

SUMMARY OF THE INVENTION

Accordingly, one object of the invention in a steam condenser of the type mentioned at the beginning is to adapt the drawing-off of the inert gases from the air cooler of each individual compartment specifically to the respective compartment and thus improve it. This is intended to achieve a cost-effective increase in the condenser efficiency.

According to the invention, this object is achieved by the features of claim 1.

The essence of the invention may be seen in the fact that the recesses for the condensate flow between adjacent compartments in the supporting plates are closed in a gas-tight and steam-tight manner. An exchange flow of residual-steam/inert-gas mixture inside the air cooler between adjacent compartments is thus prevented.

A preferred embodiment may be seen according to the invention in that at least one retaining wall arranged parallel to a supporting plate is arranged at least on the air-cooler bottom of the compartment having the air-cooler bottom situated at the lowest level, so that the condensate flowing off from a compartment situated at a higher level can be retained at this retaining wall, and thus the draining passage formed by the recesses for the condensate from a compartment situated at a higher level can be closed hydraulically in both a gas-tight and a steam-tight manner.

In any operating state of the steam condenser, the embodiment shown permits more effective utilization of the air cooler in each compartment by virtue of the fact that an equalizing flow of the residual-steam/inert-gas mixture in the air cooler between adjacent compartments is completely prevented.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing of a power station condenser, wherein.

DESCRIPTION OF THE PREFERRED EMBODIMENTS

Figure 2:
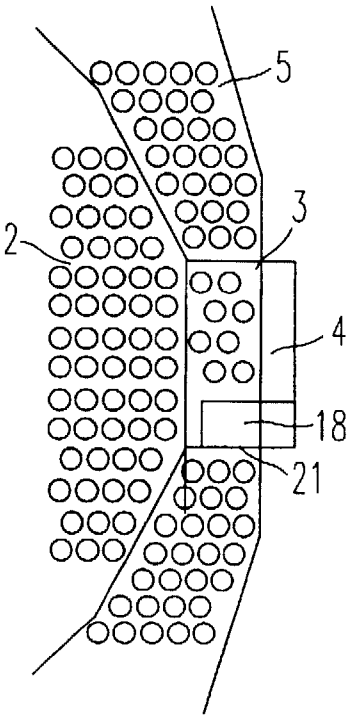
FIG. 2 shows a cross-sectional representation of the air cooler.

Referring now to the drawings, wherein like reference numerals designate identical or corresponding parts throughout the several views and only the elements essential for understanding the invention are shown, the heat exchanger shown is a surface condenser of rectangular type of construction, as is suitable for a so-called underfloor arrangement. Parts not essential to the invention, such as condenser neck, condensation space, condenser shell, water chambers, tube plates, condensate receiver, are omitted, but are briefly explained below in connection with the invention.

Steam flows into the condenser neck via an exhaust-steam connection by means of which the condenser is connected to a turbine. As homogeneous a flow zone as possible is produced in the condenser neck in order to carry out thorough steam flooding of the downstream banks 20 (FIG. 1) over their entire length. The condensation space in the interior of the condenser shell contains a plurality of banks 20 arranged next to one another. A bank consists of a number of tubes, of which in FIG. 1 only one cooling tube designated by 13 is shown. At their two ends, the cooling tubes are each fastened in tube plates. Water chambers are arranged in each case on the other side of the tube plates. The condensate flowing off from the banks 20 is collected in a condensate receiver and passes from there into the water/steam cycle.

Figure 1:
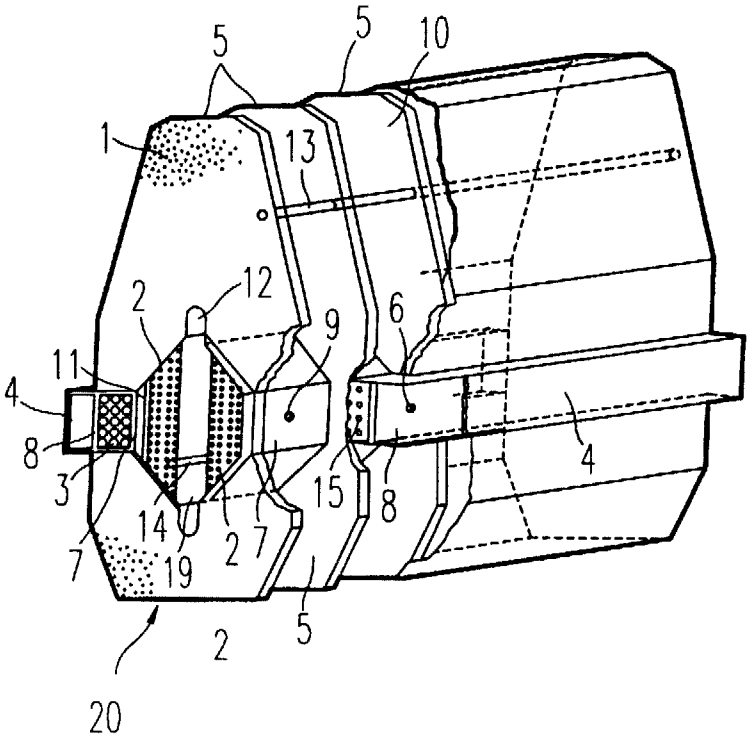
FIG. 1 shows a sectional bank of a condenser with parts shown exploded in oblique projection and having an air cooler belonging to the prior art.

In FIG. 1, the condensate part, only partly illustrated by the dotted area, of the bank 20 is designated by 1. By insertion of the continuous supporting plates 5, which serve to support the cooling tubes 13, a subdivision of the sectional banks into compartments 10 is obtained.

Arranged in the interior of each bank 20 is a hollow space 19 in which the steam enriched with non-condensable gases collects. An air cooler 3 is accommodated in this hollow space 19. The residualsteam/inert-gas mixture flows through this air cooler, in the course of which most of the steam condenses. The rest of the mixture is drawn off.

The effect of the air cooler 3 located in the interior of the tube bank is to accelerate the residual-steam/inert-gas mixture inside the condenser bank 20. The conditions are thereby improved in as much as no low flow velocities which could impair the heat transfer prevail.

In operation, the steam condenses on the tubes 13 and the condensate drips off toward the condenser bottom. The task of the air cooler 3 is to remove the non-condensable gases from the condenser. During this operation, the steam losses are to be kept as small as possible. This is achieved by the residualsteam/inert-gas mixture being accelerated in the direction of header 4. The high velocity results in good heat transfer, a factor which leads to the residual steam being largely condensed. For the purpose of accelerating the mixture, the cross section is dimensioned to be increasingly smaller in the direction of flow.

FIG. 1 shows the cooling system mentioned at the beginning and disclosed by DE-A 1 948 073. It consists of the precooler 2, of which the cooling tube 14 is illustrated, and the air cooler 3, of which the cooling tube 15 is illustrated. The air cooler 3 is separated from the header 4 by a sheet-metal wall 8 having orifices 6, via which header 4 the non-condensable gases are drawn off. The fitting of these restriction points 6, 7 ensures that the pressure difference, necessary in any case, at the start and end of the condensation operation is mainly reduced in the orifices.

The air cooler 3 with precooler 2 located in front of it and the header 4 is shown enlarged in FIG. 2. The supporting plate 5 also subdivides the air cooler 3 into compartments 10, there being a recess 18 in the supporting plate 5 toward an air-cooler bottom 21. This recess 18 permits transverse equalization of the condensate collecting in the air cooler 3. The header 4 is common to all compartments 10; it is thus not subdivided by the supporting plates 5.

Figure 3:
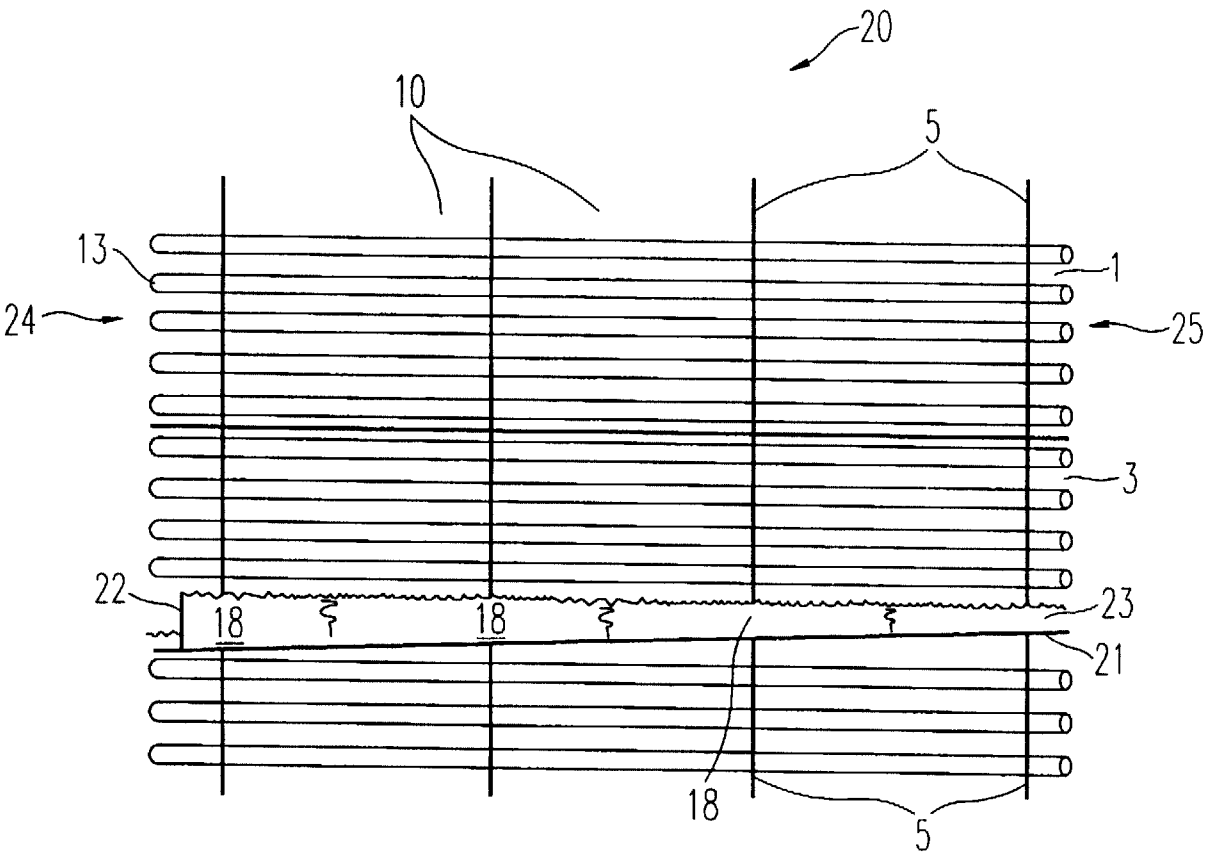
FIG. 3 shows a design of the air cooler according to the invention in longitudinal-sectional representation.

It becomes clear in the longitudinal-sectional representation of the air cooler 3 in FIG. 3 that the air-cooler bottom 21 has a slope so that condensate 23 collecting in the air cooler from compartments 10 having an air-cooler bottom situated at a higher level flows off in the direction of the compartment having the air-cooler bottom situated at the lowest level. The draining is effected in the latter, which draining is not shown here, as it is unimportant for the invention.

During fluctuating operating conditions, it is possible for the recesses 18 in the supporting plates 5 in the air cooler 3 to not be completely closed with condensate 23 flowing off. However, this means that, on account of operational pressure differences in the individual compartments 10, in addition to the condensate flow in the air cooler 3 a residual-steam/inert-gas equalizing flow can likewise occur between adjacent compartments 10. On account of the greater temperature difference between the cooling water and the inflowing steam, the compartments which are arranged nearer to the cooling-water inlet side 24 exhibit better cooling conditions than following compartments 10, which are already fed with tempered cooling water. Therefore a lower pressure appears in compartments 10 having a lower cooling-water inlet temperature, which pressure also appears of course in the region of the air cooler 3 belonging to the compartment 10. A pressure gradient is therefore to be found between the compartment 10 at the cooling-water outlet side 25 and the compartment at the cooling-water inlet side 24. In the air cooler 3, there is an equalizing flow of the residual-steam/inert-gas mixture in an operating instance of the steam condenser in which the recesses 18 in the supporting plates 5 are not closed by condensate 23. Residual-steam/inert-gas mixture then flows from compartments 10 having a higher pressure—that is also having a higher cooling-water temperature—inside the air cooler into the compartment having the lowest pressure and the lowest cooling-water temperature. In this case, the function of the air cooler 3 in the immediate vicinity of the cooling-water inlet side 24 is restricted in that compartments situated closer to the cooling-water inlet also have to vent the residual-steam/inert-gas mixture of compartments situated at a higher level instead of the residual steam/inert gases of the compartment considered locally. This likewise leads to functional losses in the precooler 2 and in the condensation part 1 of the corresponding compartment.

The intention of the invention is to eliminate these disadvantages at all operating points of a steam condenser by avoiding an equalizing flow of the residual-steam/inert-gas mixture in the air cooler 3. To this end, a retaining wall 22 is arranged according to FIG. 3 parallel to the supporting plates 5 on the bottom of the air cooler 3 in the region of the compartment 10 at the cooling-water inlet side 24. In this arrangement, the retaining wall 22 is so high that condensate 23 retained at it and flowing off from adjacent compartments 10 hydraulically closes the recesses 18 in all supporting plates 5 over the entire bank length. By means of this measure, the residual-steam/inert-gas mixture collecting in a compartment 10 of the air cooler 3 is drawn locally into the header 4. The condensate 23 flows off through the hydraulically closed recess 18 in the supporting plate 5 to the adjacent compartment 10. For the residual-steam/inert-gas mixture, an equalizing flow from compartment 10 to compartment remains prevented. The efficiency of the air cooler 3, the precooler 2 and the entire condenser system under fluctuating operating conditions is increased by avoiding an equalizing flow of the residual-steam/inert-gas mixture inside the air cooler 3. Furthermore, local increases in the concentration of inert gases are avoided.

The invention is of course not restricted to the exemplary embodiment shown and described. Thus, for example, it is conceivable as a further embodiment variant according to the invention to arrange one or more retaining walls 22 parallel to the supporting plates in each compartment on the air-cooler bottom 21.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A steam condenser in which steam is condensed on a plurality of tubes (13) through which cooling water flows and which are combined in separate banks (20), each said bank (20) being subdivided into compartments (10) by a plurality of supporting plates (5) arranged perpendicular to the tubes (13), the tubes (13) of each said bank arranged in rows enclosing a hollow space (19) in which an air cooler (3) for a residual-steam/inert-gas mixture is arranged, a bottom (21) of the air cooler (3) having a slope over an entire length of the tubes so that condensate (23) collecting in the air cooler (3) in each said compartment (10) can flow along said slope through a number of recesses (18) in the supporting plates to an adjacent compartment (10) having an air cooler bottom (21) situated at a lower level, non-condensable gases which collect in each said compartment (10) flowing from the air cooler (3) via orifices (6) into a header (4) common to all of said compartments and extending over the entire length of the tubes (13), wherein the air cooler (3) has means (22) for gas-tight and steam-tight closure of the recesses (18) so that said means (22), without impairing the condensate flow through the recesses (18), prevent a direct exchange of the residual-steam/inert-gas mixture in the air cooler (3) between adjacent compartments.

2. The steam condenser as claimed in claim 1, wherein at least one retaining wall (22) is arranged at least on the air cooler bottom (21) of the compartment (10) having the air cooler bottom situated at lowermost level, so that the condensate (23) flowing from an adjacent compartment (10) situated at a higher level can be retained at said retaining wall (22), wherein the recesses (18) for the flow of the condensate (23) from each said compartment (10) situated at a higher level can be closed hydraulically in both a gas-tight and a steam-tight manner.

* * * * *